United States Patent [19]

Matsumoto et al.

[11] 4,240,759

[45] Dec. 23, 1980

[54] MECHANICAL PENCIL HAVING GUIDES TO MATCH GUIDES ON A REFILL CARTRIDGE

[75] Inventors: Kenji Matsumoto, Tokyo; Gouji Sakaoka, Kawasaki, both of Japan

[73] Assignee: Pentel Kabushiki Kaisha, Nihonbashi, Japan

[21] Appl. No.: 922,428

[22] Filed: Jul. 6, 1978

[30] Foreign Application Priority Data

| | | | |
|---|---|---|---|
| Jul. 19, 1977 | [JP] | Japan | 52/95966[U] |
| Jul. 29, 1977 | [JP] | Japan | 52/101478[U] |
| Mar. 31, 1978 | [JP] | Japan | 53/41921[U] |

[51] Int. Cl.[3] ..... B43K 21/00

[52] U.S. Cl. ..... 401/85; 401/67; 401/86; 401/87; 401/94

[58] Field of Search ..... 401/65, 67, 85, 89, 401/90, 94, 86, 87; 285/330; 403/361, 301, 349

[56] References Cited

U.S. PATENT DOCUMENTS

| | | | |
|---|---|---|---|
| 753,096 | 2/1904 | Osteen | 285/330 X |
| 916,587 | 3/1909 | Phelan | 285/330 X |
| 1,609,729 | 12/1926 | Larsson | 401/85 X |
| 2,525,229 | 10/1950 | Lynn | 401/65 |
| 2,617,166 | 11/1952 | Kausman | 403/349 X |
| 2,712,950 | 7/1955 | Siebert | 285/330 X |
| 3,672,708 | 6/1972 | Zemberry | 403/361 X |

FOREIGN PATENT DOCUMENTS

| | | | |
|---|---|---|---|
| 917329 | 1/1947 | France | 401/94 |
| 1565562 | 5/1969 | France | 285/330 |
| 480717 | 2/1938 | United Kingdom | 401/67 |

*Primary Examiner*—Steven A. Bratlie

*Attorney, Agent, or Firm*—Wenderoth, Lind & Ponack

[57] ABSTRACT

A mechanical pencil includes a casing, a chuck for holding a lead, a lead passage connected with the chuck, a lead cartridge and a push button for advancing the lead. A cylindrical body is connected to the lead passage. The cylindrical body and the lead cartridge have guides so that the both may be snuggly and accurately engaged with each other in accordance with the diameter of leads which are used in the pencil.

13 Claims, 19 Drawing Figures

20
37
39c
39b
39
39a
41a
20a
35
34
36
30a
30
33
19
17
41
21
31

MECHANICAL PENCIL HAVING GUIDES TO MATCH GUIDES ON A REFILL CARTRIDGE

BACKGROUND OF THE INVENTION

The present invention relates to a mechanical pencil wherein a cartridge containing therein a number of leads is detachably mounted between a chuck which holds a lead at one end portion of the pencil and a push button provided at the other end. An operation of the push button causes the chuck to be opened or closed by the cartridge so that the lead may be advanced.

In conventional mechanical pencils of the type described above, lead cartridges of similar shape each of which contains therein leads of a predetermined diameter such as 0.1 mm, 0.2 mm, 0.5 mm, etc. are employed. Since each type of lead is enclosed within a similar shaped cartridge, there is possibility that a cartridge containing one type of leads is mounted in a mechanical pencil for leads of a different type. Such mismatching is often experienced by those who have two pencils or more using different types of leads, such as draftsmen. If, for example, a lead cartridge which contains leads 0.5 mm in diameter is mounted in a mechanical pencil which is designed for leads of 0.2 mm in diameter, the mechanical pencil does not work at all. Similarly, if a lead cartridge containing leads 0.1 mm in diameter is mounted in a pencil for leads 0.2 mm in diameter, the pencil does not work, either.

SUMMARY OF THE INVENTION

Accordingly, an object of the present invention is to provide a mechanical pencil which can prevent a mismatching of leads.

Another object of the present invention is to provide a mechanical pencil which does not require a troublesome lead mounting operation but permits a simple operation of lead mounting.

A further object of the present invention is to provide a mechanical pencil which has a simple structure and is economical.

Another object of the present invention is to provide a mechanical pencil in which a lead cartridge is positively engaged with a lead passage member of the pencil.

Briefly, the present invention provides a mechanical pencil which comprises a casing, a chuck for holding a lead, a lead passsage connected with the chuck, a lead cartridge and push button for advancing the lead, and a cylindrical body which is connected to the lead passage. The cylindrical body and the lead cartridge have guides so that the both are snugly and accurately engaged with each other in accordance with the diameter of leads which are used in the pencil. In one embodiment, a predetermined number of recesses are formed in the lengthwise direction at regular intervals on an outer circumferential area of the lead cartridge, whereas protrusions which correspond and engage with the recesses are formed at regular intervals on the inner circumferential surface of the cylindrical body. It is preferred that a slanting surface be formed at each of the recesses so as to ensure engagement between the lead cartridge and the cylindrical body. The recesses in the lead cartridge may be replaced by protrusions and the protrusions of the cylindrical body can be replaced by recesses.

Other objects and features of the present invention will become apparent from the detailed description of preferred embodiment thereof, which will be made with reference to the accompanying drawings.

DESCRIPTION OF THE PREFERRED EMBODIMENTS

Figure 1:
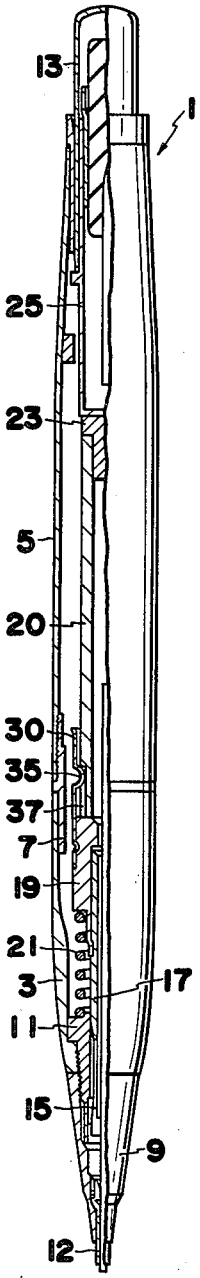
FIG. 1 is an elevation view, partly in section of a mechanical pencil in accordance with an embodiment of the present invention.

Referring to the drawings, like reference numerals represent like parts in the different views of the drawings.

In FIG. 1 which shows a first embodiment of the present invention, a mechanical pencil, generally illustrated at 1, has a front casing 3, a rear casing 5 which is threadedly engaged with the front casing 3 by a member 7 to form an outer casing, a ferrule 9 which is held in abutment with the front casing 3 by means of an annular threaded member 11, a guide tube 12, and a cap or push button 13 at the rear end of the rear casing 5. These elements form the outer cylindrical shape of the mechanical pencil 1. The mechanical pencil contains therein a chuck device 15 which is communicated with a lead passage 17, an inner casing which is referred to as an engaging member 19 and a spring 21 which is disposed between the threaded member 11 and the engaging member 19. The pencil 1 has a lead cartridge 20, which is detachably connected to the engaging member 19 in abutting relation, which will be described later with reference to FIGS. 2 to 4. The lead cartridge has a closure member 23 at the rear end thereof and contacted by a depression member 25. However, in place of the depression member, the lead cartridge can be extended longitudinally to the position where the cap 13 is disposed.

The above is the general construction common to the mechanical pencils of the present invention and to the conventional pencil, and for this reason no further detailed description thereof will be made.

Referring now to FIGS. 1, 2, 3 and 4, a cylindrical body 30 which is made of a metal is snugly and fixedly connected to the engaging member 19. The engaging member has an annular groove 31 (FIG. 3) formed on the outer circumferential surface thereof, and the cylindrical body has an annular protrusion 33 (recess in FIG. 2) on an inner surface thereof. Thus, the engagement between the cylindrical body 30 and the engaging member 19 is assured by forcibly securing the annular protrusion 33 in the annular groove 31. The cylindrical body 30 has three protrusions 35 at regular intervals on the inner surface thereof, although the inner surface is not shown in the drawings. These protrusions 35 have resiliency and may be readily formed by punching or depressing the body 30 after parallel slits 34 are formed.

Figure 2:
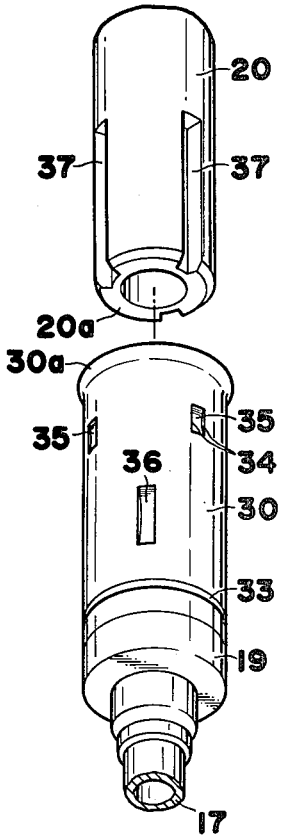
FIG. 2 is a perspective view of a lead cartridge and a cylindrical body according to a first embodiment of the invention.

A tubular lead cartridge 20, which contains therein a number of leads of the type or size to be used in the mechanical pencil, has three grooves 37 at regular intervals on the outer surface thereof. The grooves 37 which are formed in the lengthwise direction of the lead cartridge 20 starts from the front end 20*a* and terminate at a predetermined position of the lead cartridge 20, as illustrated in FIG. 2. The number of the grooves 37, three grooves are shown in FIG. 2, is determined by the diameter of leads to be used. Namely, if leads which have a diameter of 0.1 mm, for example, are used in a pencil which employs a cylindrical member having a three-groove structure, the number of grooves 37 in the lead cartridge 20 will be three. Similarly, four grooves can be used for 0.2 mm diameter leads, six grooves for 0.5 mm diameter leads, etc. Accordingly, the number of the portrusion 35 should be predetermined in accordance with diameter of the leads, otherwise the lead cartridge will not be snugly engaged with the cylindrical body 30. Thus, a user will recognize whether the leads within the lead cartridge in his hand are appropriate and of the type or size for use in his pencil or not.

Figure 3:
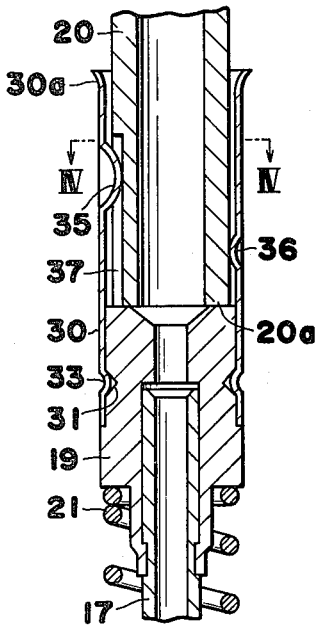
FIG. 3 is a sectional view of the elements of FIG. 2, showing the elements engaged with each other.

The cylindrical body 30 has additional protrusions 36 for holding the lead cartridge in position as shown in FIG. 3. The protrusions 35 in one row are staggered relative to the protusions 36 of the other row. Further, the cylindrical body 30 is funnel-shaped at its one end 30*a* so that the lead cartridge 20 can be readily introduced into the cylindrical body without any abutment or obstruction therebetween.

Figure 4:
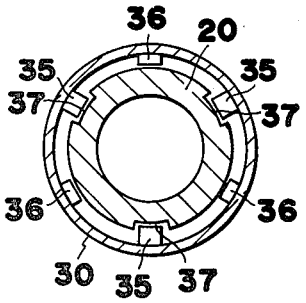
FIG. 4 is a sectional view taken along line IV—IV of FIG. 3.

In FIGS. 3 and 4 which show the lead cartridge 20 mounted in the cylindrical body 30 in abutment with the engaging member, the protrusions 35 of the cylindrical body meet with, and are snugly secured in, the grooves 37 of the lead cartridge. This means that the leads contained in the lead cartridge are appropriate for the mechanical pencil 1. If, however, it is attempted to insert a four-grooved lead cartridge into the cylindrical body 30 which has three protrusions at regular intervals, it will be found that the grooves in the four-grooved cartridge do not meet with the protrusions on the pencil. As shown particular in FIG. 4, the three protrusions 35 are fitted in the three grooves 37 in the lead cartridge, and the other portrusions 36, which are designed to project slightly less into the body 30 than the protrusions 35, are contacted with the round surface of the lead cartridge so that the lead cartridge is maintained in position and aligned with the axis, or a lead passage 17 of the pencil.

Figures 5, 6, 7, 8, 9:
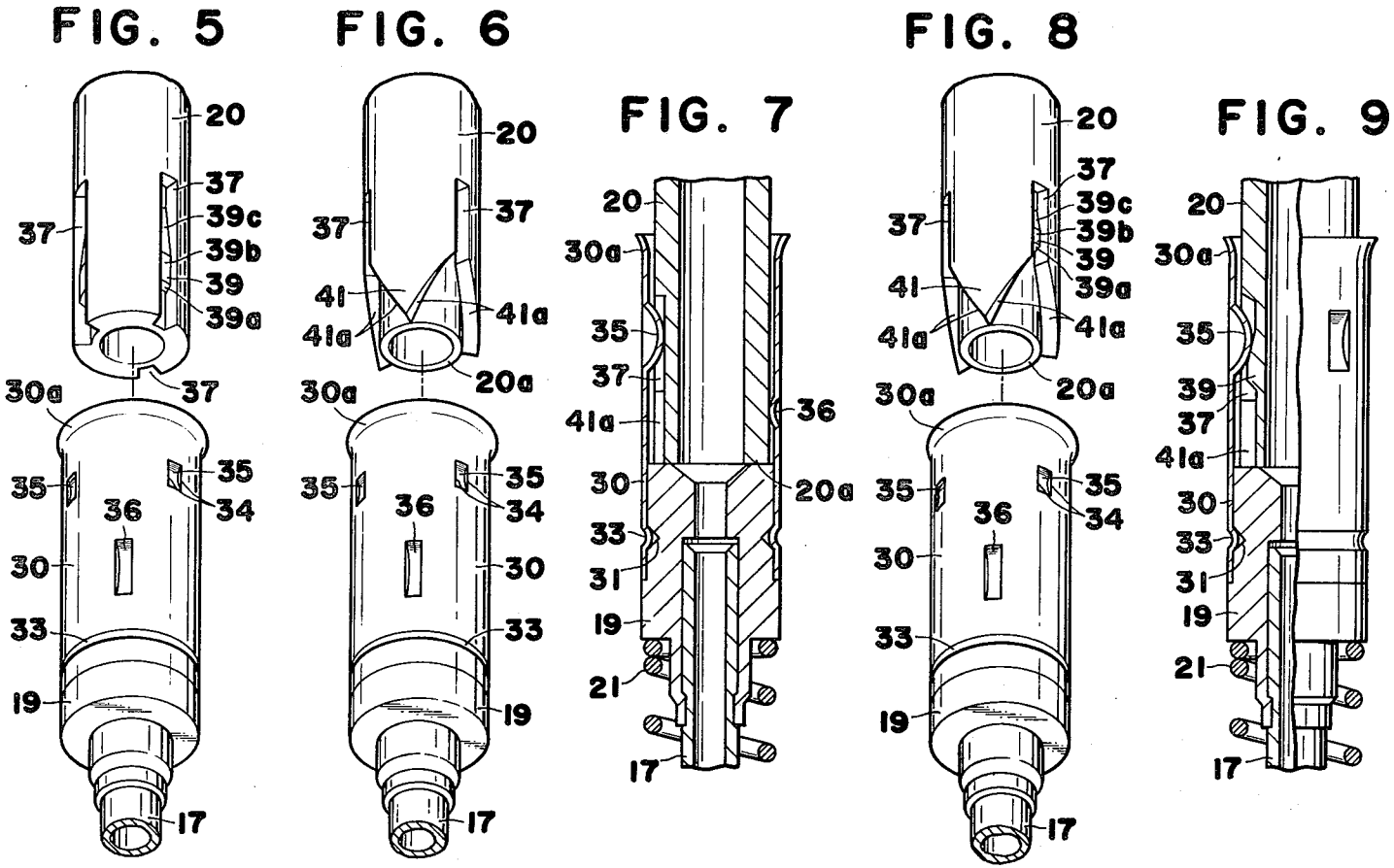
FIG. 5 is a perspective view of a lead cartridge and a cylindrical body according to a second embodiment of the invention.
FIG. 6 is a perspective view of a lead cartridge and a cylindrical body according to a third embodiment of the invention.
FIG. 7 is a sectional view of the elements shown in FIG. 6, showing the elements engaged with each other.
FIG. 8 is a perspective view of a lead cartridge and a cylindrical body according to a fourth embodiment of the invention.
FIG. 9 is a sectional view of the elements shown in FIG. 8, showing the elements engaged with each other.

In FIG. 5 which shows a second embodiment, the lead cartridge 20 has three grooves 37, the number of which is determined in correspondence with diameter of leads contained therein. The cylindrical body 30 connected at its one end to an engaging member 19 has two kinds of protrusions 35 and 36, the protrusions 35 in one row being staggered relative to the protrusions 36 of the other row. The protrusions 35 project slightly further into the body 30 than the protrusions 36. The cylindrical body 30 has a funnel-shaped opening 30*a*. The other structure as well as the structure described above is quite similar to that of the first embodiment shown particularly in FIGS. 1 and 2, except for the following structure.

The lead cartridge 20 of the second embodiment shown in FIG. 5 has a protuberance 39 in the bottom of each of the grooves 37. The protuberance 39 has a steep and short leading, in the direction of insertion slope 39*a*, a flat crest 39*b*, and a gentle and long trailing slope 39*c*. This structure permits a reliable engagement between the lead cartridge 20 and the cylindrical body 30, and smooth attachment and detachment of the lead cartridge 20.

In FIGS. 6 and 7 showing a third embodiment of the present invention, a lead cartridge 20 has grooves 37, the number of which is determined by diameter of the leads contained in the lead cartridge. FIG. 6 shows a three-groove structure which coincides with the predetermined diameter of the leads. The three grooves 37 are formed at regular intervals around the cartridge and extend in the lengthwise direction on the outer surface of the lead cartridge 20. Namely, the grooves are formed at equally spaced positions around the outer surface of the lead cartridge. Thus, three grooves are formed at angles of 120° therebetween. As the three-groove structure is used for cartridges with leads which have a diameter of 0.5 mm, a four-groove structure may be used for cartridges for the other leads such as leads 0.1 mm diameter, and similarly a five-groove structure for cartridges for leads which have diameter of, for example, 0.2 mm.

In the third embodiment, each of the longitudinal grooves 37 becomes wider at a substantially middle portion thereof as it extends toward the end 20*a* of the lead cartridge 20 with the depth being constant, to form three tapered portions 41 at the end of the lead cartridge, as shown in FIG. 6. Thus, two slanted faces 41*a* are formed on each of the adjacent tapered portions 41, the faces 41*a* being oblique relative to the lengthwise direction of the grooves 37. This structure permits a reliable and smooth engagement between the lead cartridge 20 and the cylindrical body 30 whatever the relative position between the grooves 37 and the protrusions 35 may be when the lead cartridge 20 is inserted into the cylindrical body 30 as shown in FIG. 7, as far as the lead contained in the lead cartridge 20 coincide, in respect of the diameter of the leads, with the lead used in mechanical pencil.

The cylindrical body 30 which is made of a metal has three protrusions 35, which are designed to engage in the grooves 37 of the lead cartridge 20. The protrusions 35 are at regular intervals and are formed by punching or depressing the body 30 at the three positions after parallel slits 34 are formed. Thus, the protrusions 35 which project inward of the cylindrical body 30 are formed. Additional protrusions 36, which project slightly less than the protrusions 35, are formed by a similar method in a staggered relation such that protrusions 35 in one row are staggered relative to the protrusions 36 in the other row. The structure of the cylindrical body 30 is quite similar to those of the preceeding embodiments shown in FIGS. 2 and 5, and no further detailed description will be given.

With reference to FIGS. 8 and 9 which show a fourth embodiment of the present invention, a modification is made to the structure of the lead cartridge 20 of the third embodiment shown in FIGS. 6 and 7. In this embodiment, a lead cartridge 20 of synthetic resins has a protuberance 39 on the bed of each of the grooves 37 which are formed on the outer surface of the lead cartridge 20 at the regular intervals. Each of the protuberance 39, has a steep and short slope 39*a*, a flat top 39*b* and a gentle and long slope 39*c*. This structure of the protuberance 39 is quite similar to the structure of the second embodiment shown in FIG. 5.

Each of the longitudinal grooves 37 becomes wider at a substantially middle portion thereof as it extends toward the end 20*a* of the lead cartridge 20 with the depth being constant, to form three tapered portions 41 at the end of the lead cartridge 20. Thus, two slanted faces 41*a* are formed on each of the adjacent tapered portions 41. This structure is quite similar to that of the embodiment shown in FIG. 6.

The parts of the cylindrical body 30 such as protrusions 35 and 36, annular groove 31 and funnel-shaped end 30*a* are quite similar to those of the preceding embodiments described with reference to FIGS. 2 and 5.

As illustrated in FIG. 9, the structure of the protuberances 39 provides further reliability of the engagement between the lead cartridge 20 and the cylindrical body 30.

With reference to FIGS. 10 through 14, which show a fifth embodiment of the present invention, a tubular lead cartridge 20 of synthetic resin has six protrusions 43 which are integral with the cartridge 20. The protrusions 43 are disposed at regular intervals on the outer surface of the front end portion of the cartridge 20. Each of the protrusions 43 is polygonal and has an outer extremity 43*a* and a rear end 43*b*. It should be recognized and will be apparent from the foregoing that the number of the protrusions corresponds with the kind of leads contained within the lead cartridge 20.

Figure 11:
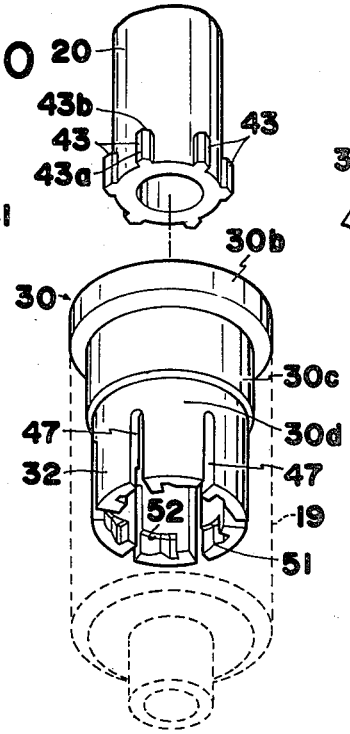
FIG. 11 is a perspective view of a lead cartridge and a cylindrical body shown in FIG. 10.

A cylindrical body 30 has a rim portion 30*b*. The tubular body 30 has six grooves 45 (FIG. 12) at the regular intervals on the inner surface in the longitudinal direction thereof. The grooves are designed to be longitudinally slidably engaged by the protrusions 43 so as to prevent a rotational movement of the lead cartridge 20. The engagement portion 30*d* is designed so that it has a slightly smaller outer diameter than the middle portion 30*c*. The engagement portion 30*d* has cuts 47 at the positions corresponding to the grooves 45. Namely, the grooves 45 open into cuts or clefts 47 at the front portion of the cylindrical body, so that six legs 32 are formed on the engagement portion 30*d* as illustrated in FIG. 11. The cuts 47 provide further flexibility to the engaging portion 30*d* of the cylindrical body 30.

Figure 13:
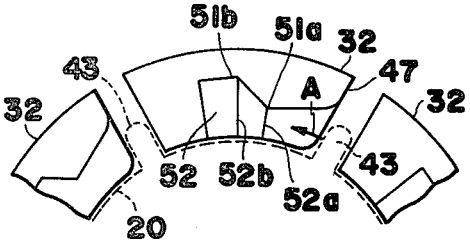
FIG. 13 is a bottom view of an end of the cylindrical body showing how the lead cartridge is engaged with the cylindrical body.
Figure 14:
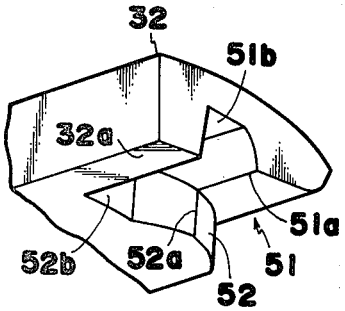
FIG. 14 is an enlarged perspective view of the end of the cylindrical body.

Each of the legs 32 has a recess 51 which has a convex portion 51*a*, a concave portion 51*b* and walls 52. The walls 52 have a convex portion 52*a* and a concave portion 52*b*, both of which are associated with the convex portion 51*a* and concave portion 51*b*, respectively in the legs 32. As shown in FIGS. 13 and 14, the recess 51 is terminated at a predetermined position in the leg leaving non-recessed portion 32*a* so that the protrusions 43 of the lead cartridge 20 abut against the non-recessed portion 32*a* when the lead cartridge is pivoted in one direction after the same is inserted fully into the cylindrical body 30.

Figure 10:
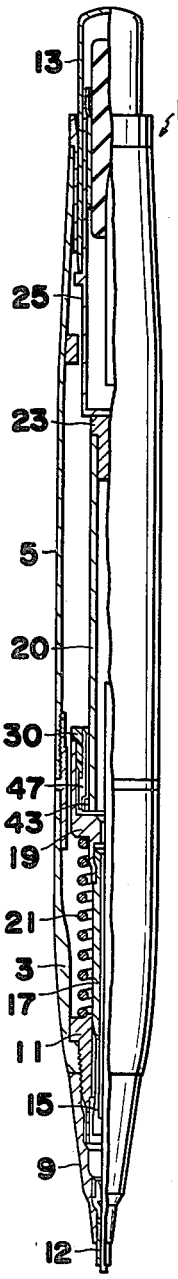
FIG. 10 is an elevation view, partly in section, of a mechanical pencil in accordance with the fifth embodiment of the invention.
Figure 12:
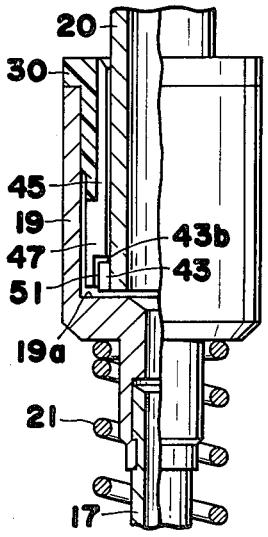
FIG. 12 is a partial sectional view of the elements shown in FIG. 10, showing the elements engaged with each other.

FIG. 12 is a fragmentary sectional view showing how the lead cartridge 20 and the cylindrical body 30 are snugly and fully mounted in an engagement member 19. The cylindrical member 30 is mounted in the engagement member 19 such that the rim portion 30*b* of the cylindrical body 30 is in abutment with the rear end portion, i.e., an upper end portion in the drawings, of the cylindrical body 30. As shown in FIG. 10, the structure of the other elements is substantially similar to the structure shown in FIG. 1, and for this reason no further detailed description will be made.

In operation, the lead cartridge 20 is inserted into the cylindrical body 30 in such a manner that the protrusions 43 slide along the grooves 45, until lead cartridge abuts against the bottom 19*a* of the engaging member 19. Here, it should be recognized that the lead cartridge 20 matches the cylindrical body 30, and therefore the leads contained within the lead cartridge are appropriate for the mechanical pencil. After the lead cartridge 20 is fully inserted into the cylindrical body 30, the lead cartridge is pivoted in the direction as illustrated by the arrow A in FIG. 13 so that the protrusions 43 are moved into the recesses 51 against the resilient force of the legs 32 of the cylindrical body 30. Here, the resilient force is provided by the cuts 47, as described before. During the pivotal movement of the lead cartridge 20, the outer extremity 43*a* and end portion 43*b* of each of the protrusions 43 contact the convex portion 51*a* and convex portion 52*a*, respectively, and then the protrusions 43 are snugly secured within the concave portion 51*b* of the recesses 51 by a further rotation of the lead cartridge 20. Thus, the lead cartridge 20 is snugly engaged with the engaging member 19 by way of the cylindrical body 30. When the lead cartridge is to be removed from the cylindrical body 30, the operation can be readily carried out by pivoting the lead cartridge 20 in the opposite direction and then pulling the lead cartridge so that the protrusions 43 will slide along the grooves 45.

Figure 15:
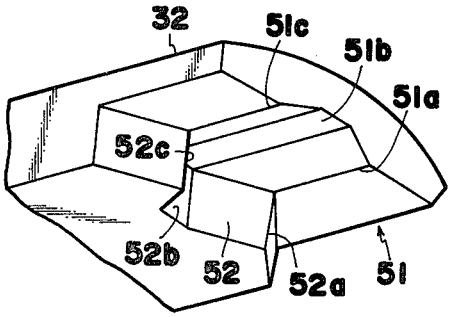
FIG. 15 is an enlarged perspective view of the end of a modified cylindrical body of the embodiment shown in FIG. 14.

In FIG. 15 which shows a modification of the recesses 51 shown in FIG. 14, each of the legs 32 of a cylindrical body 30 has a recess 51 along the entire circumferential dimension of the legs 32. The recess 51 is formed in a symmetrical manner and has symmetrical walls 52. The recess 51 has convex portions 51*a* and 51*c*, and a concave portion 51*b* between the two convex portions 51*a*, 51*b*. Similarly, the wall 52 has two convex portions 52*a* and 52*c*, and a concave portion 52*b* between the convex portions 52*a*, 52*c*.

The structure of the recesses 51 shown in FIG. 15 permits an easy and simple operation of engagement-/disengagement of the lead cartridge. In other words, the lead cartridge 20 can be engaged or disengaged with the cylindrical body 30 by merely rotating the lead cartridge 30 in either direction, as compared with the structure of FIGS. 11, 13 and 14 in which the engagement is achieved by rotating the lead cartridge in one direction and the disengagement in the other direction.

Although the present invention has been described with reference to the preferred embodiments in which the lead cartridge 20 is mounted in the cylindrical body 30 modifications may be made such that the cylindrical body may be inserted into, and mounted in, the lead cartridge.

Figure 16A:
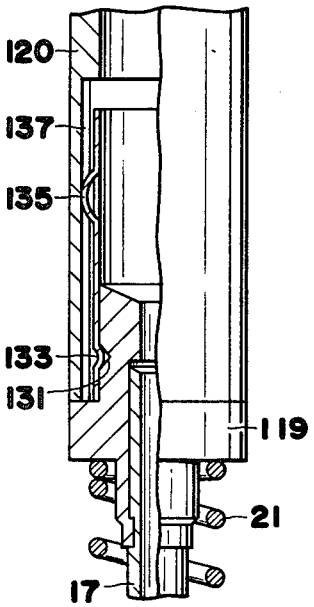
FIG. 16A is a partial sectional view of a lead cartridge and a cylindrical body in accordance with another embodiment of the invention.
Figure 16B:
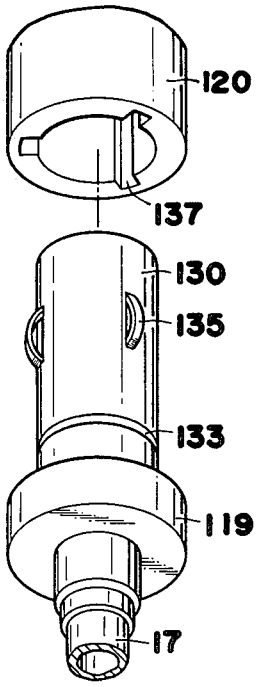
FIG. 16B is a prespective view of the elements shown in FIG. 16A.

In FIGS. 16A and 16B cartridge 120 has grooves 137 at the regular intervals on the inner surface thereof. A cylindrical body 130, which is connected to an engaging member 119 by means of the engagement in a recess 131 of the member 119 of an annular protrusion 133 on the cylindrical body, has an outer diameter slightly smaller than the inner diameter of the lead cartridge 120, and the same number of projections 135 at the regular intervals on the outer surface thereof. The projections which project outwardly can be formed by a similar method as that for forming of the inward protrusion 35 described with reference to FIGS. 1 through 4. The number of both recesses 137 and protrusions 135 are predetermined in accordance with diameter of leads contained in the cartridge. When the lead cartridge 120 coincides with the cylindrical body 130 of the mechanical pencil, the lead cartridge 120 is pushed toward the engaging member 119 in such a manner that the projections 135 slide along the grooves 137, until the lead cartridge abuts aganst the engaging member 119, as illustrated in FIG. 16A. Other elements such as the spring 21 and lead passage 17 are quite similar to the structure of the preceding embodiment, and no further description will be given thereof.

Figure 17A:
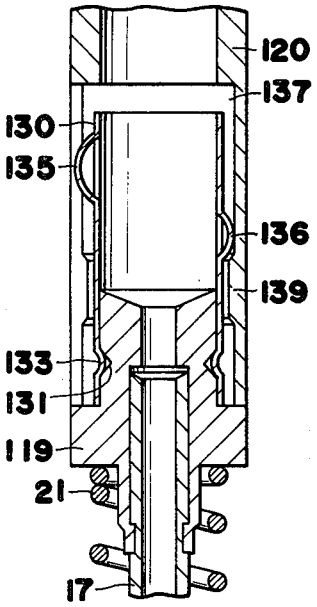
FIG. 17A is a partial sectional view of a lead cartridge and a cylindrical body in accordance with another embodiment of the invention.
Figure 17B:
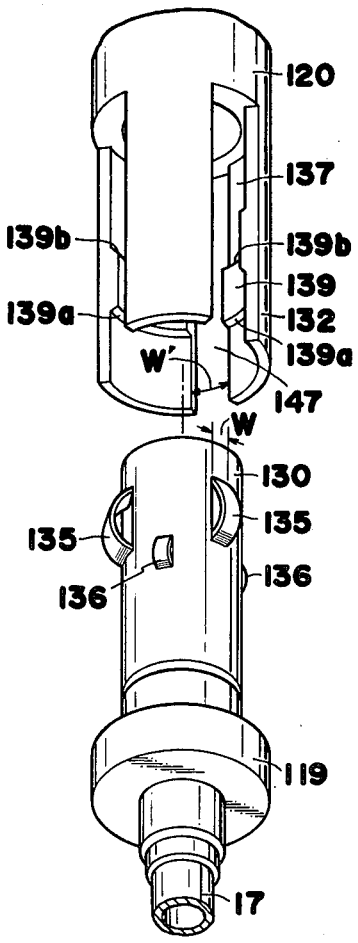
FIG. 17B is a prespective view of the elements shown in FIG. 17A.

In FIGS. 17A and 17B, which show a modification of the structure of FIGS. 16A and 16B, a lead cartridge 120 has longitudinal cuts 147 at the regular intervals to form legs 132. The lead cartridge 120 in this embodiment has a recess 137 on the entire inner surface of each of the legs 132 such that each leg has a thickness smaller than the other principal portion of the lead cartridge 120. On the middle portion of the inner surface of the legs, there are disposed protrusions 139 each of which has slanted ends 139*a* and 139*b*.

A cylindrical body 130, which is connected to the engaging member 119 by means of an enbagement in the recess of the annular projection 133, has protrusions 135 at the regular intervals on the outer surface. Additional protrusions 136, which are smaller than the protrusion 135, are formed in a staggered relation on the middle outer surface of the cylindrical body as illustrated in FIG. 17B. It is to be recognized that the width (W) of each protrusion 135 is substantially equal to or slightly smaller than, the width (W') of the corresponding cut 147. The principal portion, except for the legs, of the lead cartridge has an inner diameter which is designed to be coincide with the outer diameter of the cylindrical body 130.

Attachment of the lead cartridge 120 can be carried out by advancing the cartridge toward the engaging member 119 such that the protrusions 135 move along the cuts 147 in the lengthwise direction of the cartridge 120, until the cartridge abuts against the engaging member 119. In the process of the attachment described above, the other protrusions 136, which are smaller than the protrusions 135, are contacted at first with the slanted portions 139*a* of the protuberances 139, and then slide over the protuberance 139 against the resilient force of the protrusions by a further advance of the lead cartridge 120. Then, the protrusions 136 are positioned in the recesses 137 adjacent the slanted portions 139*b*. When the lead cartridge is fully attached, the protrusions contact the recessed area 137 of the legs 132, as illustrated in FIG. 17A.

Although the present invention has been described with reference to the preferred embodiments, many modifications may be made within the spirit of the present invention.

What is claimed is:

1. A plurality of mechanical pencils each being for a different size lead and a plurality of equal size lead cartridges respectively containing different size leads, each pencil comprising an outer casing, an inner casing having a lead gripping chuck means at the forward end thereof, a spare lead cartridge receiving housing, a lead passage between said chuck means and said spare lead cartridge receiving housing, said lead gripping chuck means and said lead passage being capable of receiving only lead of a predetermined diameter, and a spring means for pressing said inner casing rearwardly along the axis thereof, said spare lead cartridge receiving housing having therein a cylindrical body, the cylindrical bodies in the respective pencils having a predetermined number of first guide means at constant intervals therearound corresponding to the predetermined diameter of lead which can be received in said lead gripping chuck means and said lead passage of that pencil, and said lead cartridges respectively having a predetermined number of second guide means thereon corresponding to the diameter of lead therein, the first guide means in a pencil for a predetermined diameter of lead and the second guide means on a lead cartridge containing that diameter of lead being engagable with each other for fitting that cartridge to that cylindrical body, and the number of first and second guide means on a pencil and a cartridge for each predetermined diameter lead being different from the number of first and second guide means on the pencils and cartridges for the other diameter of leads, whereby only cartridges containing leads having a diameter which can be accommodated in a pencil for that diameter lead can be fitted to the pencil for that diameter lead, thereby preventing misattachment of a lead cartridge having the wrong diameter leads for a pencil to the cylindrical body of that pencil.

2. A plurality of mechanical pencils according to claim 1, in which each said lead cartridge has a predetermined number of longitudinal grooves at regular intervals on the outer surface thereof, and in which each said cylindrical body has an open end recess on the rear end with an inner diameter substantially equal to or slightly greater than the outer diameter of the lead cartridges and has first protrusions at regular intervals on the inner surface thereof for longitudinally slidably engaging in the grooves in the corresponding lead cartridge.

3. A plurality of mechanical pencils according to claim 2, in which each said cylindrical body further has additional protrusions therein, said additional protrusions being circumferentially offset relative to said first protrusions and being engagable with the corresponding cartridge to hold that cartridge in position in said body.

4. A plurality of mechanical pencils according to claim 2, in which each said lead cartridge has a protuberance on the bottom of each of said grooves, said protuberance having a first forwardly facing slope, a second rearwardly facing slope and a flat top area between said first and second slopes, said protuberances being engagable with said first protrusions for holding the corresponding cartridge in position in said body.

5. A plurality of mechanical pencils according to claim 2, in which said grooves are wider at the forward end of each said lead cartridge to thereby form tapered portions on said cartridge between the adjacent grooves.

6. A plurality of mechanical pencils according to claim 5, in which each said lead cartridge has a protuberance on the bottom of each of said grooves, said protuberance having a first forwardly facing slope, a second rearwardly facing slope and a flat top area between said first and second slopes, said protuberances being engagable with said first protrusions for holding the corresponding cartridge in position in said body.

7. A plurality of mechanical pencils according to claim 1, in which each said lead cartridge has a hollow recess at the forward end with a predetermined number of longitudinal grooves at regular intervals on the inner surface thereof, and in which each said cylindrical body has an outer diameter substantially equal to or slightly smaller than the inner diameter of said recess in the lead cartridges and protrusions at regular intervals on the outer surface thereof for longitudinally slidably engaging in the grooves in the corresponding lead cartridge.

8. A plurality of mechanical pencils according to claim 1, in which each said lead cartridge has a hollow recess on the forward end with a predetermined number of cuts therein at regular intervals to define legs on the forward end, said lead cartridge having a peripherally extending recess along the entire inner surface of each of said legs, said legs each having a protuberance on the middle of the length of the inner surface thereof, and in which each said cylindrical body has first projections at regular intervals around the outer surface thereof and second projections at substantially the middle portion of the length of the outer surface thereof, said second projections being circumferentially offset to said first projections and being engagable behind said protuberances when the corresponding cartridge is forced over said cylindrical body.

9. A plurality of mechanical pencils according to claim 1, in which each said lead cartridge has predetermined numbers of protrusions at regular intervals on the outside of the forward end portion thereof, and each said cylindrical body has a hollow recess in the rear end thereof with longitudinal grooves at regular intervals in an inner surface thereof, said grooves and protrusions on corresponding cartridges and cylindrical bodies being slidably engagable with each other.

10. A plurality of mechanical pencils according to claim 9, in which each of said protrusions on the lead cartridge is integral with said lead cartridge and has a pentagonal cross-sectional shape.

11. A plurality of mechanical pencils according to claim 9, in which each said cylindrical body has a rim at its rear end, a first segment extending forwardly from said rim and a second segment extending forwardly from said first segment, each said cylindrical body being secured within said inner casing with said rim in abutment with the rear end of said inner casing, said second segment being slightly smaller in outer diameter than said first segment, and having cuts at the position where said grooves are formed to thereby form legs, said cuts starting at the forward end of said second segment and terminating at the rear portion to thereby make said legs resilient, said legs each having a recess on the inside surface thereof at the forward end thereof for tightly receiving said protrusions on the corresponding lead cartridge with said legs resiliently engaging said protrusions.

12. A plurality of mechanical pencils according to claim 11, in which said recesses start at a side edge of the leg and terminate short of the other side edge, said recesses each having a concavo-convex side wall, and a forwardly facing concavo-convex surface.

13. A plurality of mechanical pencils according to claim 11, in which said recess is symmetrical relative to the longitudinal direction of said leg, said recess having a crest at each side of the leg and a trough between said crests, said recess having a side wall and a forwardly facing surface, both said side wall and forwardly facing surface having two crest portions and a trough portion between said crest portions.

* * * * *